US007727696B2

(12) United States Patent
Lai et al.

(10) Patent No.: US 7,727,696 B2
(45) **Date of Patent: *Jun. 1, 2010**

(54) TONER COMPOSITIONS

(75) Inventors: Zhen Lai, Webster, NY (US); Yuhua Tong, Webster, NY (US); Chieh-Min Cheng, Rochester, NY (US); Christopher M. Wolfe, Webster, NY (US)

(73) Assignee: Xerox Corporation, Stamford, CT (US)

( * ) Notice: Subject to any disclaimer, the term of this patent is extended or adjusted under 35 U.S.C. 154(b) by 710 days.

This patent is subject to a terminal disclaimer.

(21) Appl. No.: 11/636,081

(22) Filed: Dec. 8, 2006

(65) Prior Publication Data

US 2008/0138732 A1 Jun. 12, 2008

(51) Int. Cl.
*G03G 9/00* (2006.01)

(52) U.S. Cl. ..... 430/110.2; 430/109.3; 430/137.11; 430/137.14

(58) Field of Classification Search ..... 430/110.2, 430/109, 3, 137.11, 137.14
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,990 | A | 5/1981 | Stolka et al. |
| 4,394,430 | A | 7/1983 | Jadwin et al. |
| 4,560,635 | A | 12/1985 | Hoffend et al. |
| 4,563,408 | A | 1/1986 | Lin et al. |
| 4,584,253 | A | 4/1986 | Lin et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,227,460 | A | 7/1993 | Mahabadi et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 5,928,830 | A | 7/1999 | Cheng et al. |
| 6,004,714 | A | 12/1999 | Ciccarelli et al. |
| 6,190,815 | B1 | 2/2001 | Ciccarelli et al. |
| 6,326,117 | B1 | 12/2001 | Ishihara |
| 7,553,601 | B2 * | 6/2009 | Lai et al. ..... 430/137.14 |
| 2006/0105263 | A1 | 5/2006 | Moffat et al. |
| 2006/0135650 | A1 | 6/2006 | Moffat et al. |

FOREIGN PATENT DOCUMENTS

| | | |
|---|---|---|
| DE | 11 15 580 B | 10/1961 |
| EP | 1 548 511 | 6/2005 |
| EP | 1 655 639 | 5/2006 |
| EP | 1 777 591 | 4/2007 |
| EP | 1 850 188 | 10/2007 |

OTHER PUBLICATIONS

European Search Report dated Aug. 11, 2009 for European Patent Appln. No. EP 07 12 2688.
European Search Report dated Jul. 14, 2009 for European Appln. No. EP 07 11 0188.

* cited by examiner

*Primary Examiner*—Mark A Chapman
(74) *Attorney, Agent, or Firm*—Carter, DeLuca, Farrell & Schmidt, LLP

(57) ABSTRACT

A toner having its surface functionalized with alkaline resins is provided, and processes for producing the same.

16 Claims, 1 Drawing Sheet

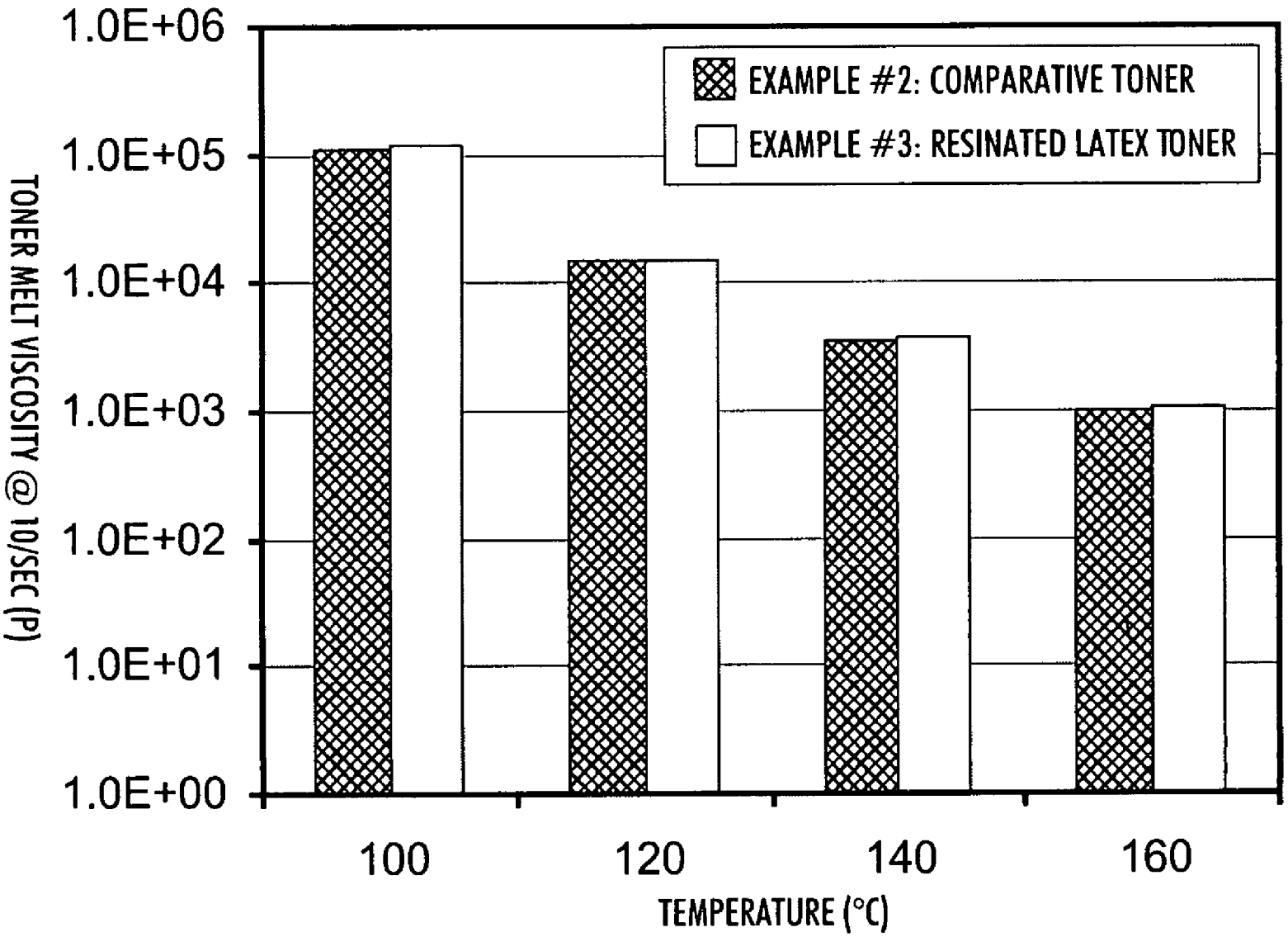
EXAMPLE #2: COMPARATIVE TONER
EXAMPLE #3: RESINATED LATEX TONER
1.0E+06
1.0E+05
1.0E+04
1.0E+03
1.0E+02
1.0E+01
1.0E+00
TONER MELT VISCOSITY @ 10/SEC (P)
100
120
140
160
TEMPERATURE (°C)

TONER COMPOSITIONS

BACKGROUND

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner can also be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.1 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

To enable "offset" print quality with powder-based electrophotographic development systems, small toner particles (about 5 micron diameter) may be desired. Although the functionality of small, triboelectrically charged toner has been demonstrated, concerns remain regarding the long-term stability and reliability of such systems.

Development systems which use triboelectricity to charge toner, whether they be two component (toner and carrier) or single component (toner only), may exhibit nonuniform distribution of charges on the surfaces of the toner particles. This nonuniform charge distribution may result in high electrostatic adhesion because of localized high surface charge densities on the particles. For example, the electrostatic adhesion forces for tribo-charged toner, which are dominated by charged regions on the particle at or near its points of contact with a surface, do not rapidly decrease with decreasing size. This so-called "charge patch" effect makes smaller, triboelectric charged particles much more difficult to develop and control. Triboelectricity may also be unpredictable because of the sensitivity of the materials utilized in forming toner.

The sensitivity of toner charge to relative humidity (RH) has also been a problem for developers in general, and for color developers in particular, mainly due to the fact that the surfaces of toner particles may be very sensitive to relative humidity. Sensitivity to relative humidity may give rise to various problems, including toner particle agglomeration and clogging of the apparatus using such toner.

Improved methods for producing toner, which minimize sensitivity to relative humidity, decrease the production time, and permit excellent control of the charging of toner particles, remain desirable.

SUMMARY

The present disclosure provides toner compositions. In embodiments, a toner of the present disclosure may include a core including a first latex, a colorant, and an optional wax, and a shell including a second latex functionalized with an alkaline resin.

In embodiments, toners of the present disclosure may include a latex, a colorant, and an optional wax, wherein the toner possesses particles having a BET surface area of from about 1 $m^2/g$ to about 5 $m^2/g$, a ratio of J-Zone charge to B-Zone charge from about 1 to about 2, and a ratio of J-Zone charge to A-Zone charge from about 1.15 to about 2.55.

In yet other embodiments, toners of the present disclosure may include a core including a first latex such as styrenes, acrylates, methacrylates, butadienes, isoprenes, acrylic acids, methacrylic acids, acrylonitriles, and combinations thereof having a glass transition temperature from about 45° C. to about 65° C., a colorant including a magenta pigment such as Pigment Red 122, Pigment Red 185, Pigment Red 192, Pigment Red 202, Pigment Red 206, Pigment Red 235, Pigment Red 269, and combinations thereof, and an optional wax. The toners also include a shell including a second latex such as styrenes, acrylates, methacrylates, butadienes, isoprenes, acrylic acids, methacrylic acids, acrylonitriles, and combinations thereof having a glass transition temperature from about 45° C. to about 70° C., functionalized with an alkaline resin including calcium resinates, beryllium resinates, magnesium resinates, strontium resinates, barium resinates, radium resinates, zinc resinates, aluminum resinates, copper resinates, iron resinates, and combinations thereof.

BRIEF DESCRIPTION OF THE DRAWINGS

Various embodiments of the present disclosure will be described herein below with reference to the FIGURE wherein:

The FIGURE includes a graph comparing melt viscosity of a toner of the present disclosure with a conventional toner.

DETAILED DESCRIPTION OF EMBODIMENTS

The present disclosure provides processes for the preparation of toner particles having reduced sensitivity to relative humidity and excellent charging characteristics. The present disclosure provides processes for the preparation of toner particles utilizing a surface-functionalized latex. The surface of the latex may be functionalized with an alkaline earth resin, in embodiments a calcium resinate compound. In embodiments the toner may be of a core/shell configuration, wherein the latex utilized to form the shell is functionalized with the alkaline earth resin. Resulting toner particles have excellent triboelectric robustness, for example the ability to retain a uniform triboelectric charge. This ability to retain a uniform triboelectric charge may help lower key toner failure modes in an apparatus utilizing such a toner, and also increase productivity and reduce the unit manufacturing cost (UMC) for the toner.

In embodiments, toner particles may possess a core-shell configuration with functional groups in the latex shell which render the shell more hydrophobic and thus less sensitive to relative humidity. In embodiments, the present disclosure includes the preparation of toner by blending a colorant and a wax with a latex polymer core, optionally with a flocculent and/or charge additives, and heating the resulting mixture at a temperature below the glass transition temperature (Tg) of the latex polymer to form toner sized aggregates. In embodiments, the colorant may include a magenta pigment. A functionalized latex may then be added as a shell latex, followed by the addition of a base and cooling. The functionalized latex may include an alkaline earth resin so that the resulting particles possess a surface functionalized with the alkaline earth resin. In some embodiments, the latex utilized to form the core may also be functionalized with an alkaline earth resin. Subsequently heating the resulting aggregate suspension at a temperature at or above the Tg of the latex polymer will result in coalescence or fusion of the core and shell, after which the toner product may be isolated, such as by filtration, and thereafter optionally washed and dried, such as by placing in an oven, fluid bed dryer, freeze dryer, or spray dryer.

Toners of the present disclosure may include a latex in combination with a pigment. While the latex may be prepared by any method within the purview of one skilled in the art, in embodiments the latex may be prepared by emulsion polymerization methods and the toner may include emulsion aggregation toners. Emulsion aggregation involves aggregation of both submicron latex and pigment particles into toner size particles, where the growth in particle size is, for example, in embodiments from about 3 microns to about 10 microns.

Any monomer suitable for preparing a latex emulsion can be used in the present processes. Suitable monomers useful in forming the latex emulsion, and thus the resulting latex particles in the latex emulsion include, but are not limited to, styrenes, acrylates, methacrylates, butadienes, isoprenes, acrylic acids, methacrylic acids, acrylonitriles, mixtures thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures and combinations thereof. The polymer may be block, random, or alternating copolymers. In addition, polyester resins obtained from the reaction of bisphenol A and propylene oxide or propylene carbonate, and in particular including such polyesters followed by the reaction of the resulting product with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol, may also be used.

In embodiments, a poly(styrene-butyl acrylate) may be utilized as the latex. The glass transition temperature of this first latex, which in embodiments may be used to form the core of a toner of the present disclosure, may be from about 45° C. to about 65° C., in embodiments from about 48° C. to about 62° C.

In embodiments, the latex may be prepared in an aqueous phase containing a surfactant or co-surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., mixtures thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, and the like, and mixtures thereof. In embodiments a suitable cationic surfactant includes SANISOL B-50 available from Kao Corp., which is primarily a benzyl dimethyl alkonium chloride.

Examples of nonionic surfactants include, but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be selected.

The choice of particular surfactants or combinations thereof as well as the amounts of each to be used are within the purview of those skilled in the art.

In embodiments initiators may be added for formation of the latex. Examples of initiators include water soluble initiators, such as ammonium persulfate, sodium persulfate and potassium persulfates, and organic soluble initiators including organic peroxides and azo compounds including Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent, and in embodiments of from about 0.2 to about 5 weight percent of the monomers.

In embodiments, chain transfer agents may be utilized including dodecane thiol, octane thiol, carbon tetrabromide, mixtures thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

In some embodiments a pH titration agent may be added to control the rate of the emulsion aggregation process. The pH titration agent utilized in the processes of the present disclosure can be any acid or base that does not adversely affect the products being produced. Suitable bases can include metal hydroxides, such as sodium hydroxide, potassium hydroxide, ammonium hydroxide, and optionally mixtures thereof. Suitable acids include nitric acid, sulfuric acid, hydrochloric acid, citric acid, acetic acid, and optionally mixtures thereof.

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter as determined, for example, by a Brookhaven nanosize particle analyzer.

After formation of the latex particles, the latex particles may be utilized to form a toner. In embodiments, the toners are an emulsion aggregation type toner that are prepared by the aggregation and fusion of the latex particles of the present disclosure with a colorant, and one or more additives such as surfactants, coagulants, waxes, surface additives, and optionally mixtures thereof.

The latex particles may be added to a colorant dispersion. The colorant dispersion may include, for example, submicron colorant particles in a size range of, for example, from about 50 to about 500 nanometers and, in embodiments, of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as C1 60710, C1 Dispersed Red 15, diazo dye identified in the Color Index as C1 26050, C1 Solvent Red 19, copper tetra(octadecyl sulfonamido) phthalocyanine, x-copper phthalocyanine pigment listed in the Color Index as C1 74160, C1 Pigment Blue, Anthrathrene Blue identified in the Color Index as C1 69810, Special Blue X-2137, diarylide yellow 3,3-dichlorobenzidene acetoacetanilides, a monoazo pigment identified in the Color Index as C1 12700, C1 Solvent Yellow 16, a nitrophenyl amine sulfonamide identified in the Color Index as Foron Yellow SE/GLN, C1 Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 20 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, and the like, and combinations thereof, may be utilized as the colorant. Pigment Red 122 (sometimes referred to herein as PR-122) has been widely used in the pigmentation of toners, plastics, ink, and coatings, due to its unique magenta shade. The chemical structures of PR-122, Pigment Red 269, and Pigment Red 185 are set forth below.

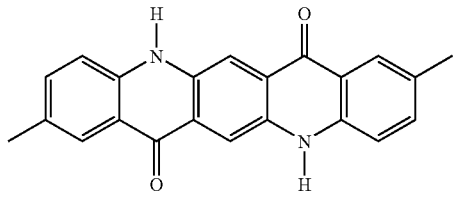

Pigment PR 122 (2,9-dimethylquinacridone)

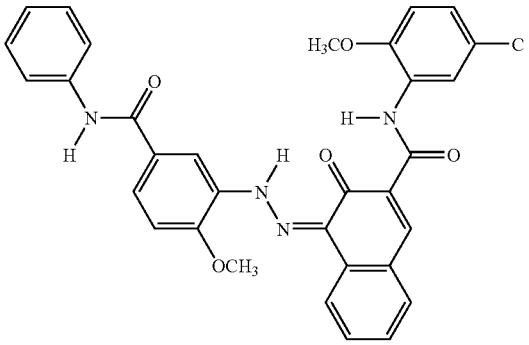

Pigment Red 269

-continued

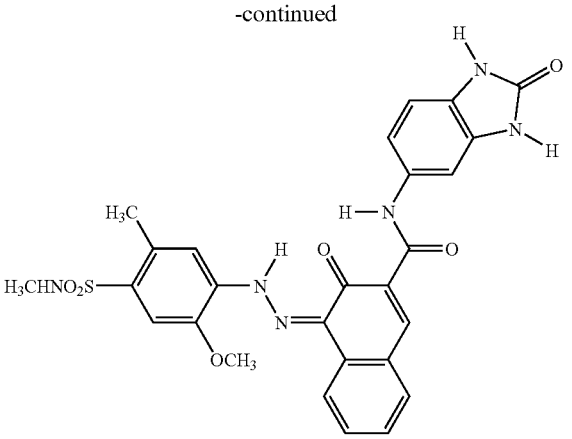

Pigment Red 185

Wax dispersions may also be added to toners of the present disclosure. Suitable waxes include, for example, submicron wax particles in the size range of from about 50 to about 500 nanometers, in embodiments of from about 100 to about 400 nanometers in volume average diameter, suspended in an aqueous phase of water and an ionic surfactant, nonionic surfactant, or mixtures thereof. Suitable surfactants include those described above. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, and in embodiments from about 2 to about 20 percent by weight of the toner.

In embodiments, it may be advantageous to include a stabilizer when forming the latex particles and/or combining the latex particles with the colorant dispersion and the optional wax dispersion. Suitable stabilizers include monomers having carboxylic acid functionality. Such stabilizers may be of the following formula (I):

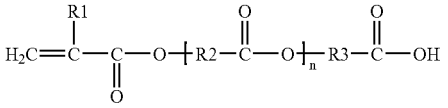

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl) acrylate, 2-carboxyethyl methacrylate, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.05 to about 5 percent by weight of the stabilizer having carboxylic acid functionality, in embodiments from about 0.8 to about 2 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

In embodiments, a coagulant may be added during or prior to aggregating the latex and the aqueous colorant dispersion. The coagulant may be added over a period of time from about 1 to about 20 minutes, in embodiments from about 1.25 to about 8 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 2 percent by weight of the toner, and in embodiments from about 0.1 to about 1.5 percent by weight of the toner.

Any aggregating agent capable of causing complexation might be used in forming toner of the present disclosure. Both alkali earth metal or transition metal salts can be utilized as aggregating agents. In embodiments, alkali (II) salts can be selected to aggregate sodio sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally mixtures thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, mixtures thereof, and the like.

Stabilizers that may be utilized in the toner formulation processes include bases such as metal hydroxides, including sodium hydroxide, potassium hydroxide, ammonium hydroxide, and optionally mixtures thereof. Also useful as a stabilizer is a composition containing sodium silicate dissolved in sodium hydroxide.

The resultant blend of latex, optionally in a dispersion, colorant dispersion, optional wax, optional coagulant, and optional aggregating agent, may then be stirred and heated to a temperature below the Tg of the latex, in embodiments from about 30° C. to about 60° C., in embodiments of from about 45° C. to about 55° C., for a period of time from about 0.2 hours to about 6 hours, in embodiments from about 1 hour to about 2.5 hours, resulting in toner aggregates of from about 3 microns to about 15 microns in volume average diameter, in embodiments of from about 4 microns to about 8 microns in volume average diameter.

In embodiments, a shell may then be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 45° C. to about 70° C., in embodiments from about 50° C. to about 65° C.

In embodiments, the shell latex, the core latex, or both, may be functionalized with a group that imparts hydrophobicity to the latex so that the latex possesses excellent sensitivity to relative humidity. Suitable functional groups include, for example, alkaline earth resins or other metal resins including, but not limited to, calcium resinates, beryllium resinates, magnesium resinates, strontium resinates, barium resinates, radium resinates, zinc resinates, aluminum resinates, copper resinates, iron resinates, and combinations thereof. In embodiments, the surface-functionalized latex may possess a calcium resinate as the functional group. Suitable calcium resinates include those of the following formulae:

(II)

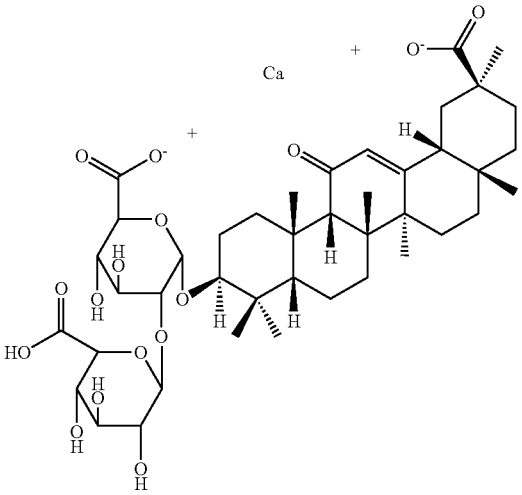

or (III)

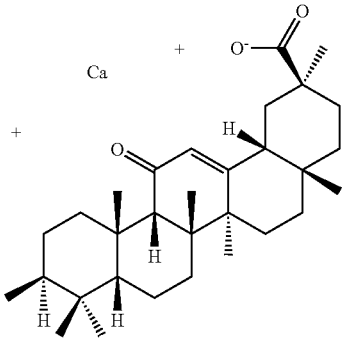

In embodiments, other alkaline earth metals may be combined with the resinate structure of formula I above in place of calcium. Such alkaline earth metals include, for example, beryllium, magnesium, strontium, barium, sodium, potassium, and combinations thereof.

The alkaline resin may be present at the surface of the toner. Where a shell latex is not utilized, it may be useful to functionalize the latex utilized to form the toner particles with the functional groups described above. Where a shell latex is utilized, the shell latex, and optionally the core latex, may be functionalized with the functional groups described above.

The alkaline resin may be present in an amount from about 0.01 to about 2 percent by weight of the toner, in embodiments from about 0.02 to about 1 percent by weight of the toner.

Where utilized, the shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex in which the alkaline resin may be added during shell synthesis. Thus, in embodiments, the toner particles may be prepared by in-situ seeded semi-continuous emulsion copolymerization of styrene and n-butyl acrylate (BA), in which calcium resinate may be introduced at the later stage of reaction for the shell synthesis.

Once the desired final size of the toner particles is achieved, the pH of the mixture may be adjusted with a base to a value of from about 5 to about 7, and in embodiments from about 6 to about 6.8. The base may include any suitable base such as, for example, alkali metal hydroxides such as, for example, sodium hydroxide, potassium hydroxide, and ammonium hydroxide. The alkali metal hydroxide may be added in amounts from about 0.1 to about 10 percent by weight of the mixture, in embodiments from about 1 to about 8 percent by weight of the mixture.

The mixture of latex, colorant and optional wax is subsequently coalesced. Coalescing may include stirring and heating at a temperature of from about 90° C. to about 99° C., for a period of from about 0.5 hours to about 12 hours, and in embodiments from about 2 hours to about 6 hours. Coalescing may be accelerated by additional stirring.

The pH of the mixture is then lowered to from about 3 to about 6 and in embodiments, to from about 3.7 to about 5.5 with, for example, an acid to coalesce the toner aggregates. Suitable acids include, for example, nitric acid, sulfuric acid, hydrochloric acid, citric acid or acetic acid. The amount of acid added may be from about 1 to about 30 percent by weight of the mixture, and in embodiments from about 5 to about 15 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

After this cooling, the aggregate suspension may be heated to a temperature at or above the Tg of the first latex used to form the core and the Tg of the second latex used to form the shell to fuse the shell latex with the core latex. In embodiments, the aggregate suspension may be heated to a temperature from about 80° C. to about 120° C., in embodiments from about 85° C. to about 98° C., for a period of time from about 1 hour to about 6 hours, in embodiments from about 2 hours to about 4 hours, to fuse the shell latex with the core latex.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 60° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner may also include charge additives in effective amounts of, for example, from about 0.1 to about 10 weight percent of the toner, in embodiments from about 0.5 to about 7 weight percent of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, mixtures thereof, and the like.

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

The resultant toner particles have less sensitivity to relative humidity compared with conventional toners due to their increased surface hydrophobicity from the introduction of the functionalized latex as the shell of the toner. The hydrophobicity of the resultant toner particle can be characterized through contact angle measurements between a toner particle film and water, and the water resistance of the toner film. The toner particle film can be prepared by fusing the toner particle at elevated temperature (above about 150° C.). The contact angle of deionized water can be measured using a Rame Hart Contact Angle Goniometer commercially available from Rame Hart Instrument Inc. for the film-air surface. The contact angle of water on the film of the present disclosure may be above about a 70° angle.

Toners of the present disclosure possess excellent humidity resistant toner properties, such as the ratio of J-zone charge to A-zone charge is from about 1.15 to about 2.55, in embodiments from about 1.2 to about 2, and wherein the ratio of J-zone charge to B-zone charge is from about 1 to about 2, in embodiments from about 1.05 to about 1.5, wherein the A-zone is at about 80 percent relative humidity, the B-zone is at about 50 percent relative humidity, and the J-zone is at about 10 percent relative humidity.

In embodiments, toners of the present disclosure possessing a latex having a surface functionalized with an alkaline earth resin may be utilized in conjunction with a magenta pigment including, but not limited to, Pigment Red 122, Pigment Red 185, Pigment Red 192, Pigment Red 202, Pigment Red 206, Pigment Red 235, Pigment Red 269, combinations thereof, and the like. In embodiments, Pigment Red 122 may be utilized. Due to its rod-like molecular structure and dense crystal clusters, Pigment Red 122 may have poor miscibility with conventional emulsion aggregation latex resins. In accordance with the present disclosure, functionalizing the surface of the latex with an alkaline earth resin such as calcium resinate will increase the hydrophobicity of the latex particle surface and improve its compatibility with PR-122. This may reduce the interfacial tension between the pigment dispersion and the latex, resulting in denser packed toner particle aggregates produced in the emulsion aggregation process. The reduced interfacial tension between the pigment and latex polymer chains may also enhance the interdiffusion of the polymer chains, improving the coalescence of particles, and eventually resulting in relatively lower BET.

The BET of the particles is the specific surface area of the particles as determined using the BET (Brunauer, Emmett, Teller) method. The BET method employs nitrogen as an adsorbate to determine the surface area of the toner particles. Briefly, the BET method includes introducing a suitable amount of the toner particles into a BET tube, in embodiments from about 0.5 grams to about 1.5 grams, and then degassing the sample using flowing nitrogen at a temperature from about 25° C. to about 35° C. for a period of time from about 12 hours to about 18 hours prior to analysis. The multi point surface area may be determined using nitrogen as the adsorbate gas at about 70 Kelvin to about 84 Kelvin ($LN_2$), over a relative pressure range of from about 0.1 to about 0.4, in embodiments from about 0.15 to about 0.3. A cross-sectional area of the nitrogen adsorbate of about 15 square angstroms to about 17 square angstroms, in embodiments about 16.2 square angstroms, may be used to calculate surface area. In embodiments, the BET data may also be determined and calculated at a relative pressure of about 0.2 to about 0.4, in embodiments about 0.3. Various apparatus are commercially available for conducting this analysis and determining the BET of the particles. One example of such an apparatus is a TriStar 3000 Gas Adsorption Analyzer from Micromeritics Instrument Corporation (Norcross, Ga.).

It has been found that toners prepared with the latex of the present disclosure have significantly lower particle BETs of from about 1 $m^2/g$ to about 5 $m^2/g$, in embodiments from about 1.1 $m^2/g$ to about 4 $m^2/g$, as well as a narrow distribution of BET values, for example a variation of from about 0.1 to about 1 $m^2/g$ from batch to batch, in embodiments a variation of from about 0.2 $m^2/g$ to about 0.9 $m^2/g$ from batch to batch, due to the increase in the latex hydrophobicity and the resulting improved compatibility of resins with pigments.

A stable triboelectric charge is very important to enable good toner performance. One of the biggest challenges with current toners, including current magenta formulations, is controlling the parent particle BET. A high BET may result in unstable (low) triboelectric charging, and over-toning, as well as cleaning blade filming problems. Thus, utilizing the processes of the present disclosure, one may be able to shorten the production time of a toner possessing excellent BET, which in turn permits excellent control of the charging characteristics of the resulting toner. Toners prepared with the latexes of the present disclosure thus avoid problems found with high magenta particle BET and BET variability, including triboelectric variability and cleaning problems in engines that use emulsion aggregation toners.

Following the methods of the present disclosure, surface hydrophobicity of the latex was increased, resulting in the improved compatibility of resins with pigments, especially for a magenta pigment such as PR-122. Compared with conventional emulsion aggregation latexes, the resinate surface-functionalized latex of the present disclosure offers several advantages: (1) lowers the intrinsic particles' BET under the same process conditions; (2) increases the robustness of the particles' triboelectric charging through better particle BET control, which reduces the toner defects and improves the machine performance; (3) easy to implement, no major changes to existing aggregation/coalescence processes; (4) and increases productivity and reduces unit manufacturing cost (UMC) by reducing the production time and the need for rework (quality yield improvement).

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by discharged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A monomer emulsion was prepared by agitating a monomer mixture (about 630 grams of styrene, about 140 grams of n-butyl acrylate, about 23.2 grams of beta-carboxyethyl acrylate (β-CEA) and about 5.4 grams of 1-dodecanethiol) with an aqueous solution (about 15.3 grams of DOWFAX 2A1 (an alkyldiphenyloxide disulfonate surfactant from Dow Chemical), and about 368 grams of deionized water) at about 300 rpm at a temperature from about 20° C. to about 25° C.

About 1.1 grams of DOWFAX 2A1 (47% aq.) and about 736 grams of deionized water were charged in a 2L jacketed stainless steel reactor with double P-4 impellers at about 300 rpm, and deaerated for about 30 minutes while the temperature was raised to about 75° C.

About 11.9 grams of the monomer emulsion described above was then added into the stainless steel reactor and was stirred for about 8 minutes at about 75° C. An initiator solution prepared from about 11.6 grams of ammonium persulfate in about 57 grams of deionized water was added to the reactor over about 20 minutes. Stirring continued for about an additional 20 minutes to allow seed particle formation. The first half of the remaining monomer emulsion was fed into the reactor over about 130 minutes. A latex core having a particle size of about 150 nm was formed at this point, with a Mw of about 50 kg/mole (as determined by gel permeation chromatography (GPC)).

A mixture of about 10 grams of calcium resinate, about 7.3 grams of styrene and about 2.7 grams of n-butyl acrylate were combined by mixing them with a magnetic stirring bar at about 300 RPM for one hour at room temperature, i.e., from a bout 20° C. to about 25° C. The resulting mixture and about 6.5 grams 1-dodecanethiol were added into the remaining monomer emulsion prepared above, and stirred at about 300 rpm for about 20 minutes. Then, this new monomer emulsion was fed into the reactor over 90 minutes. After that, a polymer shell with resinate functional groups on the particle surface formed around the core. The shell had a thickness of about 40 nm.

At the conclusion of the monomer feed, the emulsion was post-heated at about 75° C. for about 3 hours and then cooled. Passing a stream of nitrogen through the emulsion throughout the reaction deoxygenated the reaction system. This final latex had an average particle size of about 190 nm, Mw of about 35 kg/mole (as determined by GPC), and a Tg of about 59° C., with about 42 percent solids. This latex was very stable and sediment-free.

It is believed the resinate groups were incorporated into the latex shell polymer chains through chain transfer reaction during the polymerization.

Example 2

A control toner was prepared as follows. About 60 g of a polyethylene wax dispersion commercially available as POLYWAX 725® from Baker-Petrolite, about 85.4 g of Pigment Red 122 dispersion, about 21.3 g of Pigment Red 185 dispersion (Pigment Red 185 is a magenta pigment), about 919 g of deionized water, and about 265.7 g of a poly(styrene-co-n-butyl acrylate) latex produced following the procedures described above in Example 1, except that no calcium resinate was added, were mixed and homogenized at about 4000 rpm at a temperature from about 20° C. to about 25° C. About 3.6 g DelPAC 2000 (an aluminum chloride hydroxide sulfate commercially available from Delta Chemical Corporation) in about 32.4 g of 0.02 N $HNO_3$ solution was added dropwise into the mixture while homogenizing for about 3 minutes. After the addition, the viscous mixture was continuously homogenized for about another 5 minutes. Then, the slurry was transferred into a 2-L reactor. The reactor was set up with stirring speed of about 350 rpm and heating bath temperature of about 65° C. Within about 40 minutes, the slurry temperature was brought to about 60° C. After aggregation at about 60° C. for about 20 minutes, the particle size by volume was about 5.5 microns. Then, about 149.3 g of a shell latex (EP2-26P) was added into the reactor over a period of time of about 5 minutes. About 15 minutes after the addition, the particle size was about 6.7 microns.

The slurry pH was adjusted to about 5.2 by the addition of about 4% NaOH solution. Then, the slurry was heated to about 96° C., and the pH of the hot slurry was adjusted to about 4.2 by the addition of about 0.3 N $HNO_3$ solution. After about 3 hours coalescence, the circularity of the toner particles reached about 0.963. Then, the slurry was cooled to a temperature from about 20° C. to about 25° C. The solid was collected by filtration, and washed by deionized water.

Example 3

A toner was prepared following the same procedures described above in Example 1, except that the latexes (both for the core and the shell) were functionalized with calcium resinate using the same procedure as described in Example 1.

The volume median particle size and the circularity of the toner particles was determined using a Coulter Counter Multisizer II particle sizer.

A multi point BET (Brunauer, Emmett, Teller) method employing nitrogen as the adsorbate was used to determine the surface area of the toner particles of both this toner and the control toner of Example 2. Approximately one gram of the sample was accurately weighed into a BET tube. The sample was degassed using flowing nitrogen at about 30° C. on a VacPrep 061 (available from Micromeritics Instrument Corporation of Norcross, Ga.) for a period of time from about 12 hours to about 18 hours prior to analysis. The multi point surface area was determined using nitrogen as the adsorbate gas at about 77 Kelvin ($LN_2$), over the relative pressure range of about 0.15 to about 0.3. The cross-sectional area of the nitrogen adsorbate used in the calculation was about 16.2 square angstroms. The single point BET data was also reported and was calculated at a relative pressure of approximately 0.30. The sample was analyzed on a TriStar 3000 Gas Adsorption Analyzer from Micromeritics Instrument Corporation (Norcross, Ga.). The results of the BET data and the other properties of the toner particles are summarized below in Table 1. Temperature and relative humidity (RH) settings for the A-zone was about 80° F. and about 80% RH; for the B-Zone was about 70° F. and about 50% RH; and for the J-Zone was about 70° F. and about 10% RH.

TABLE 1

| | | | | BET $N_2$ Surface Area | | | J | |
|---|---|---|---|---|---|---|---|---|
| | Particle size, um | Circularity | Particle Tg (° C.) | Multi point ($m^2/g$) | Single point ($m^2/g$) | B Zone Tribo mC/g | Zone Tribo mC/g | J/B |
| Example 2 (CONTROL) | 6.69 | 0.963 | 59.2 | 8.04 | 7.44 | 20.53 | 36.21 | 1.76 |
| Example 3 (resinated latex toner) | 6.71 | 0.961 | 59.1 | 3.55 | 3.26 | 45.10 | 50.11 | 1.11 |

From Table 1, it can be seen that under similar process conditions the toners produced with calcium resinate surface-functionalized latex possessed much lower BET and higher parent particle triboelectric charge than the one prepared with regular latex. It can also be seen the triboelectric charge difference between B-zone and J-zone was larger for Example 2 than Example 3, indicating that the toner made by Example 3 had lower RH sensitivity. Based on historical data, it was well understood that for the control, a lower BET can be achieved by changing the aggregation/coalescence process through extending the cycle time from 18 hours all the way to 27 hours in single development toner compositions. The data shown in Table 1 also suggests a reduction in the total aggregation/coalescence process cycle time can be achieved using calcium resinate surface-functionalized latex.

Toner particle films were prepared by melting about 20 grams of the dry toner particles on a glass substrate at about 180° C. The contact angle of de-ionized water with the resulted toner particle film was measured using a Rame Hart Contact Angle Goniometer from Rame Hart Instrument Inc. The film with resinated latex toner demonstrated a higher contact angle (about 87°) than the control sample, which had a contact angle of about 65°. The results confirmed the increased toner hydrophobicity.

The melt viscosity of the control toner of Example 2 and the toner of the present disclosure prepared in accordance with Example 3 was determined by a Davenport melt viscometer. The FIGURE shows the comparison of the toner melt viscosity at different temperatures under shear rate of about 10/sec. As is apparent from the FIGURE, the viscosities of the resinated latex toner of the present disclosure Example 3 were almost the same as the control toner Example 2, suggesting that the surface-functionalized latex had minimal impact on the toner fusing properties.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a core comprising a first latex, a colorant, and an optional wax; and a shell comprising a second latex functionalized with an alkaline resin.

2. A toner as in claim 1, wherein the first latex and the second latex are the same or different and are selected from the group consisting of styrenes, acrylates, methacrylates, butadienes, isoprenes, acrylic acids, methacrylic acids, acrylonitriles, and combinations thereof, the first latex has a glass transition temperature from about 45° C. to about 65° C., and the second latex has a glass transition temperature from about 45° C. to about 70° C.

3. A toner as in claim 1, wherein the first latex and the second latex are the same or different and are selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butaiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

4. A toner as in claim 1, wherein the first latex and optionally the second latex are contacted with a stabilizer of formula (I)

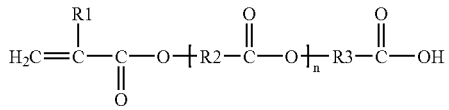

wherein R1 is selected from the group consisting of hydrogen and methyl, R2 and R3 are independently selected from the group consisting of alkyl groups having from about 1 to about 12 carbon atoms and phenyl groups, and n is from about 0 to about 20.

5. A toner as in claim 4, wherein the stabilizer is selected from the group consisting of beta carboxyethyl acrylate, poly(2-carboxyethyl) acrylate, 2-carboxyethyl methacrylate, and acrylic acid and its derivatives.

6. A toner as in claim 1, wherein the alkaline resin functional groups of the second latex are selected from the group consisting of calcium resinates, beryllium resinates, magnesium resinates, strontium resinates, barium resinates, radium resinates, zinc resinates, aluminum resinates, copper resinates, iron resinates, and combinations thereof.

7. A toner as in claim 1, wherein the alkaline resin functional groups of the second latex comprise a calcium resinate selected from the group consisting of (II)

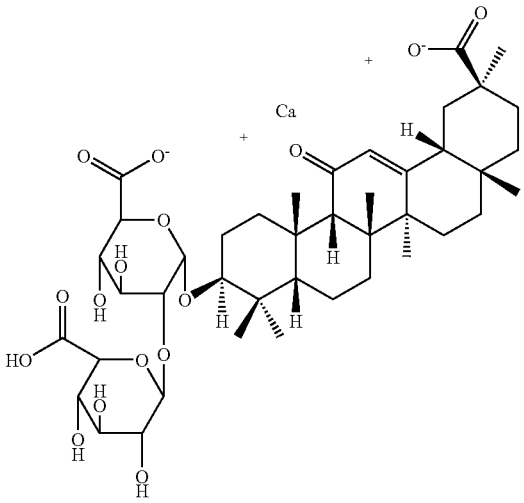

and

-continued (III)

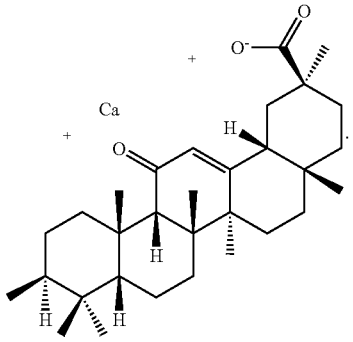

8. A toner as in claim 1, wherein the colorant comprises a magenta pigment selected from the group consisting of Pigment Red 122, Pigment Red 185, Pigment Red 192, Pigment Red 202, Pigment Red 206, Pigment Red 235, Pigment Red 269, and combinations thereof

9. A toner as in claim 1, wherein the first latex comprises a poly(styrene-butyl acrylate) optionally possessing functional groups comprising an alkaline resin, and the second latex comprises a poly(styrene-butyl acrylate) functionalized with a calcium resinate.

10. A toner as in claim 1, wherein the toner particles have a size from about 1 micron to about 20 microns, and a circularity from about 0.9 to about 0.99.

11. A toner as in claim 1, wherein the toner particles possess a ratio of J-Zone charge to B-Zone charge from about 1 to about 2, and a ratio of J-Zone charge to A-Zone charge from about 1.15 to about 2.55.

12. A toner as in claim 1, wherein the toner particles possess a BET surface area of from about 1 $m^{2/}g$ to about 5 $m^{2/}g$.

13. A developer composition comprising the toner of claim 1.

14. The toner of claim 1, wherein the second latex is selected from the group consisting of styrenes, acrylates, methacrylates, butadienes, isoprenes, acrylic acids, methacrylic acids, acrylonitriles, and combinations thereof, having a glass transition temperature from about 45° C. to about 70° C. and the alkaline resin functional groups of the second latex are selected from the group consisting of calcium resinates, beryllium resinates, magnesium resinates, strontium resinates, barium resinates, radium resinates, zinc resinates, aluminum resinates, copper resinates, iron resinates, and combinations thereof

15. A toner comprising:

a core comprising a first latex selected from the group consisting of styrenes, acrylates, methacrylates, butadienes, isoprenes, acrylic acids, methacrylic acids, acrylonitriles, and combinations thereof having a glass transition temperature from about 45° C. to about 65° C., a colorant comprising a magenta pigment selected from the group consisting of Pigment Red 122, Pigment Red 185, Pigment Red 192, Pigment Red 202, Pigment Red 206, Pigment Red 235, Pigment Red 269, and combinations thereof, and an optional wax; and a shell comprising a second latex selected from the group consisting of styrenes, acrylates, methacrylates, butadienes, isoprenes, acrylic acids, methacrylic acids, acrylonitriles, and combinations thereof having a glass transition temperature from about 45° C. to about 70° C., functionalized with an alkaline resin selected from the group consisting of calcium resinates, beryllium resinates, magnesium resinates, strontium resinates, barium resinates, radium resinates, zinc resinates, aluminum resinates, copper resinates, iron resinates, and combinations thereof.

16. The toner of claim 15, wherein the first latex and the second latex are the same or different and are selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate- butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof, and the alkaline resin functional groups of the second latex comprise a calcium resinate selected from the group consisting of (II)

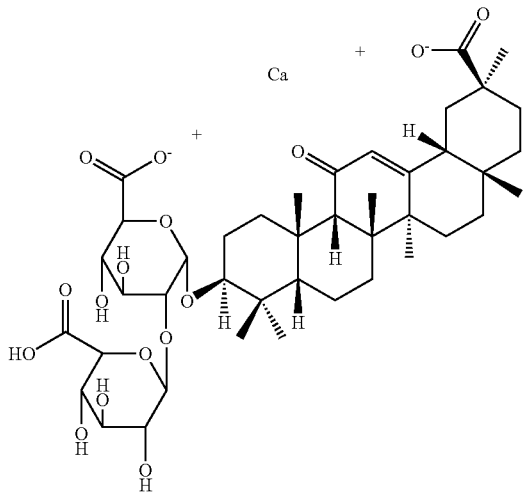

and (III)

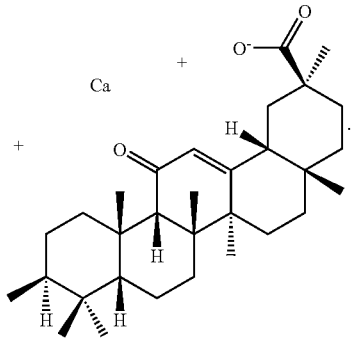

* * * * *